US006247586B1

(12) United States Patent
Herzog et al.

(10) Patent No.: US 6,247,586 B1
(45) Date of Patent: Jun. 19, 2001

(54) TWO-COMPONENT CONTAINER

(75) Inventors: Volker Herzog, Riedstadt; Joerg Mayer, Darmstadt-Eberstadt; Udo Kohn, Dieburg; Franz Steigerwald, Griesheim, all of (DE)

(73) Assignee: Wella Aktiengesellschaft, Darmstadt (DE)

( * ) Notice: Subject to any disclaimer, the term of this patent is extended or adjusted under 35 U.S.C. 154(b) by 0 days.

(21) Appl. No.: 09/424,394

(22) PCT Filed: Jan. 28, 1999

(86) PCT No.: PCT/EP99/00542

§ 371 Date: Feb. 22, 2000

§ 102(e) Date: Feb. 22, 2000

(87) PCT Pub. No.: WO99/48771

PCT Pub. Date: Sep. 30, 1999

(30) Foreign Application Priority Data

Mar. 23, 1998 (DE) ..... 198 12 657

(51) Int. Cl.[7] ..... B65D 81/32
(52) U.S. Cl. ..... 206/221; 215/DIG. 8
(58) Field of Search ..... 206/219–222, 206/568; 215/DIG. 8; 604/416; 141/319

(56) References Cited

U.S. PATENT DOCUMENTS 2,793,776 * 5/1957 Lipari ..... 206/221
4,784,658 * 11/1988 Grabenkort ..... 604/416
5,064,059 * 11/1991 Ziegler et al. ..... 206/221
5,186,323 * 2/1993 Pfleger ..... 206/221
5,277,303 * 1/1994 Goyet et al. ..... 206/221
5,419,445 * 5/1995 Kaesemeyer ..... 215/DIG. 8

FOREIGN PATENT DOCUMENTS

2339388 * 2/1975 (DE) .
1542467 * 10/1968 (FR) .
2610901 * 8/1988 (FR) .

* cited by examiner

*Primary Examiner*—Jim Foster
(74) *Attorney, Agent, or Firm*—Michael J. Striker

(57) ABSTRACT

In a two-component container (1) a connection is formed between two chambers (6, 7) by ejecting a sealing plug (5). By screwing one container (3) into a thread (4) connected to another container (2) the sealing plug (5) which is provided with two stoppers (12, 13) is pressed out of its retaining members (14, 15). Sealing takes place in a reliable manner by two separate stoppers (12, 13) of the sealing plug (5). When the container (3) is screwed in, first the lower stopper (13) is ejected by the upper stopper (12) and then the upper stopper (12) is ejected by an ejection member (22). The two-component container (1) is suitable for holding peroxide and hair dye separately. After it has been ejected, the sealing plug (5) assists in the mixing of the said two components.

5 Claims, 3 Drawing Sheets

TWO-COMPONENT CONTAINER

BACKGROUND OF THE INVENTION

The invention relates to a two-component container, with two containers separate from each other and communicating with each other after a sealing plug has been ejected, each container comprising a chamber for receiving a component, with a thread on a neck of one container and a further thread joined to the other container, the threads meshing with each other, and one container can be screwed against the other container in such a way that the sealing plug is forced out of the mounting thereof.

In the case of known two-component containers of this type, in which a film is provided as a sealing means between the containers, materials with good barrier properties are used for producing the film in order to prevent diffusion between a peroxide present in one chamber and a hair dye in the other chamber. Sealing by way of a single sealing point results in insecure sealing, in particular during mass production of the two-component container.

A two-component container is known from FR-2610901, in which a component present in an upper container can be added to a component present in a lower container. For this purpose, the closure of the lower container is first pressed out downwards and the second closure arranged on the base of the upper container is then removed.

SUMMARY OF THE INVENTION

The object of the invention is to arrange a two-component container of the type described in the introduction in such a way that secure sealing is produced between the individual containers, and a simple and safe mixing of the components is achieved.

According to the Invention sealing plug comprises two individual stoppers, wherein the upper stopper is releasable upwards from a retaining member connected to the upper container, the lower stopper is removable downwards from a retaining member of an intermediate member by the resistance of the upper stopper, the intermediate member rests with a support on the upper edge of the lower container, and the intermediate member is provided with a separate ejection member acting against the upper stopper.

The two-component container according to the invention has the advantage that it is provided with a double sealing between the individual components, since each stopper performs a sealing action. The individual components are mixed in a simple manner by screwing in the lower container in the direction of the upper container. Mixing takes place safely in that first the lower stopper and then the upper stopper is ejected. The lower stopper is ejected by the upper stopper, and the latter is ejected in turn by the ejection member.

The lower stopper is ejected when the retaining members are still relatively far from each other after a slight rotation of the lower container, if the upper stopper has a wall area extending parallel or substantially parallel to an outer wall of the container and a central area resting on the lower stopper. Retaining members spaced far apart from each other prevent, to an even greater extent, the individual components from coming into contact with each other between the stoppers.

If the ejection member can be placed against a seal joined to the upper container or if it rests against the said seal, a good sealing of the two-component container is achieved after the mixing of the components. In this case, a continuous resilient wall is particularly suitable as a seal.

A securing ring, after the separation of which a container can be screwed against the other container, is used to prevent the two-component container from being activated in an undesired manner.

BRIEF DESCRIPTION OF THE DRAWING

The invention is described in greater detail below with reference to an embodiment. In the drawing

DESCRIPTION OF THE EXEMPLARY EMBODIMENTS

Figure 1:
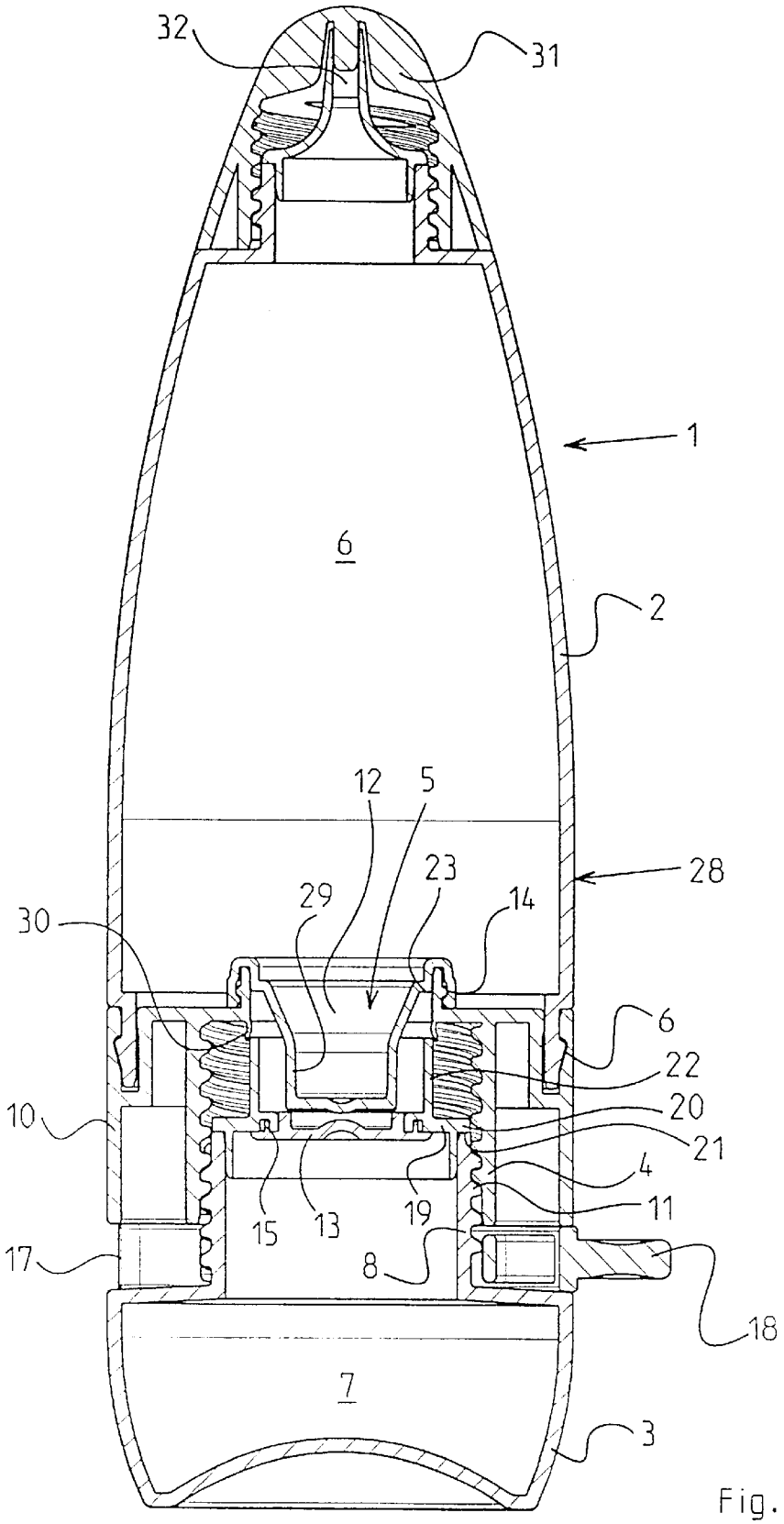
FIG. 1 is a vertical section through a two-component container with two containers which are sealed off from each other by means of two individual stoppers, the upper stopper being removable upwards and the lower stopper being removable downwards each from a respective retaining member, the lower stopper being removable by an intermediate member by the resistance of the upper stopper, the intermediate member resting with a support on the upper edge of the lower container, and the intermediate member having a separate ejection member which acts against the upper stop.
Figure 2:
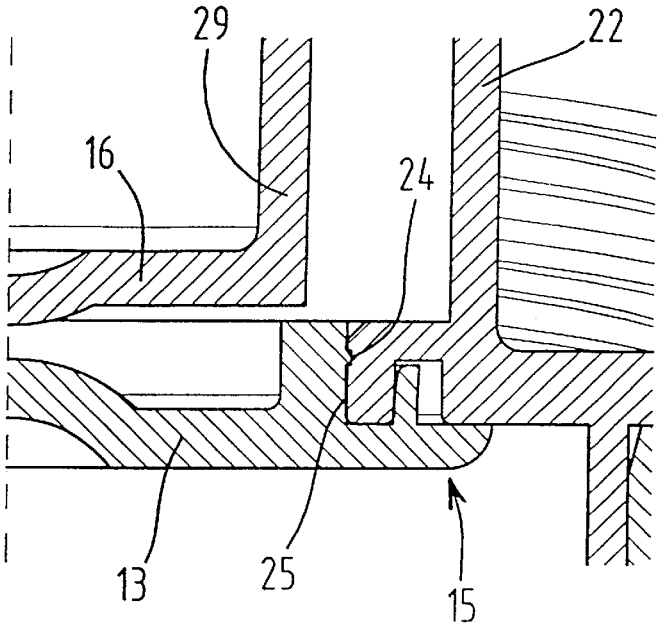
FIG. 2 is a cut-away view of FIG. 1 in a vertical section and on a larger scale.

In a two-component container 1 two individual containers 2, 3 are connected to each other by way of threads 4, 11. After a combined sealing plug 5 has been ejected the contents of the containers 2, 3 can be mixed together (FIG. 1). Each container 2, 3 comprises one chamber 6, 7. Whilst one chamber 6 is provided to receive a peroxide as one component, the other chamber 7 is used to receive a hair dye as a second component.

A thread 11, which engages in the thread 4 of a central member 10, is provided on the neck 8 of the lower container 3. The central member 10 is connected to the container 2 by way of a snap connexion 6. The lower container 3 can be screwed against the upper container 2, in which case first the lower stopper 13 of the sealing plug 5 and then the upper stopper 12 of the sealing plug 5 is ejected.

The individual stoppers 12, 13 together form the sealing plug 5. The upper stopper 12 is forced upwards out of the retaining member 14 connected to the upper container 2. The lower stopper has a more easily releasable retaining member 15 than the upper stopper 12. The lower stopper 13 is thus ejected from the central region 16 of the upper stopper 12, whilst the upper stopper 12 remains in the retaining member 14 thereof. After a securing ring 17 which can be gripped at the tab 18 is torn off, the lower stopper 13 is ejected by the resistance of the upper stopper 12 and drops down from an intermediate member 19. After the securing ring 17 has been removed from the two-component container 1, the lower container 3 can be screwed further against the upper container 2.

The intermediate member 19 rests with a support 20 against the upper edge 21 of the lower container 3. The intermediate member 19 is provided with an ejection member 22 which acts against the upper stopper 12 and releases it from the retaining member 14 thereof upon reaching an annular surface 23. The retaining member 15 has a press seating 25 in combination with a catch connexion 24 (FIG.

Figure 3:
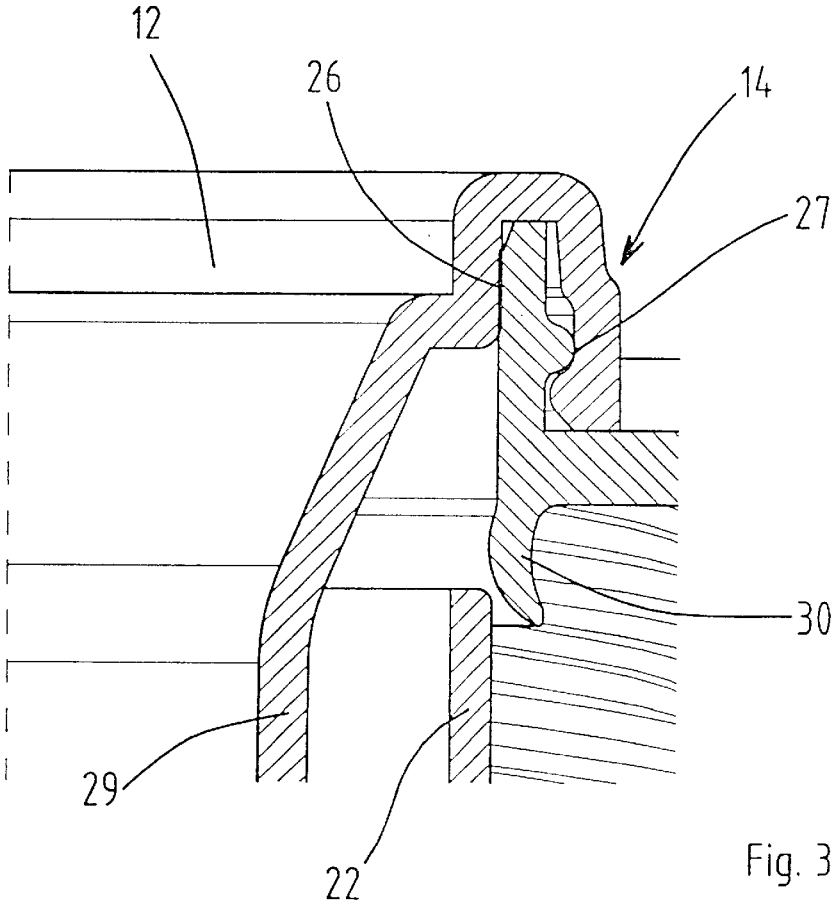
FIG. 3 is a further cut-away view of FIG. 1 in a vertical section and on a larger scale.

2). The retaining member 14 likewise has a press seating 26 and a catch connexion 27 (FIG. 3).

The upper stopper 12 has a wall area 29 which extends parallel to the outer wall 28 of the container and which passes into a central area 16 resting on the lower stopper 13.

Figure 4:
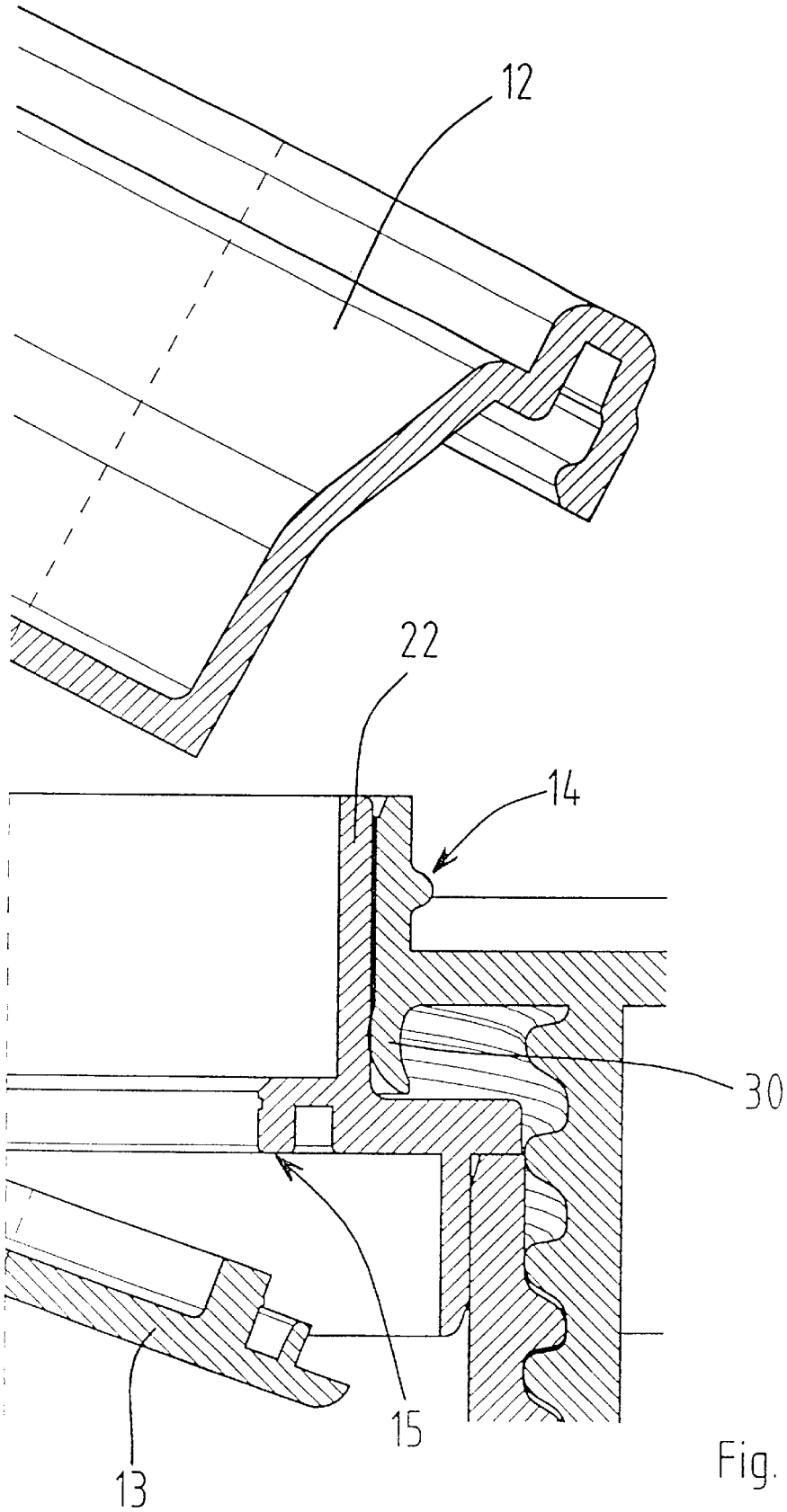
FIG. 4 is a further cut-away view of FIG. 1 in a vertical section and on a larger scale, but with the stoppers released from the retaining members thereof.

As the lower container 3 is screwed further, the ejection member 22 rests against a seal 30—joined to the upper container 2—of a continuous resilient wall and in this way seals the two-component container 1. In the state where screwing-in has taken place to the maximum extent, as illustrated in FIG. 4, the stoppers 12, 13 are released from the retaining members 14, 15 and the previously separated components can be mixed.

The two-component container 1 is then shaken, and finally, after unscrewing a closure cap 31, the active hair dye is applied through a discharge opening 32 (FIG. 1).

What is claimed is:

1. A two-component container comprising respective individual containers (2,3) provided with corresponding chambers (6,7) for containing respective components, said respective individual containers (2,3) having corresponding threaded necks provided with mutually meshing threads (4,11) so that one (3) of said individual containers (2,3) is connected with another (2) of said individual containers via said threaded necks;

a retaining member (14) connected to said another (2) of said individual containers and arranged between said another (2) of said individual containers and said one (3) of said containers;

an intermediate member (19) bearing with a supporting portion (20) thereof on a facing edge (21) of one (8) of said threaded necks of said one (3) of said individual containers, wherein said intermediate member (19) is arranged between said retaining member (14) and said one (8) of said threaded necks, said intermediate member (19) is provided with retaining means (15) on a side of said intermediate member (19) opposite from said retaining member (14) and said intermediate member (19) includes a protruding ejection member (22) on another side of said intermediate member (19) facing said retaining member (14);

a sealing plug (5) arranged in a sealing position in said threaded necks to temporarily seal said chambers (6,7) from each other, but which is ejected from said sealing position when said one (3) of said individual containers is screwed sufficiently far into said another of said individual containers, wherein said sealing plug (5) comprises a first stopper (12) and a second stopper (13), said first stopper (12) is releasably connected with said retaining member (14) so as to be releasable in a direction away from said retaining member (14) and said second stopper (13) is releasably connected with said intermediate member by means of said retaining means (15) on said side of said intermediate member opposite from said retaining member (14);

whereby, when said one (8) of said individual containers is screwed sufficiently far into said another (2) of said individual containers to eject said sealing plug (5) from said sealing position, said intermediate member (19) is moved toward said another (2) of said individual containers by said one (8) of said threaded necks, so that said second stopper (13) is disengaged from said retaining means (15) and thus said intermediate member (19) by contact with said first stopper (12) and then said first stopper (12) is disengaged from said retaining member (14) by said protruding ejection member (22) of said intermediate member (19).

2. The two-component container as defined in claim 1, wherein said another (2) of said individual containers has an outer wall (28), said first stopper (12) has a wall region (29) extending substantially parallel with said outer wall (28) and a central area (16) resting on said second stopper (13) before ejection of said sealing plug from said sealing position.

3. The two-component container as defined in claim 1, wherein said retaining member (14) has a resilient seal (30) which engages with said protruding ejection member (22) when said one of said individual containers is screwed sufficiently far into said another (2) of said individual containers to eject said sealing plug (5) from said sealing position.

4. The two-component container as defined in claim 3, wherein said resilient seal (30) comprises a continuous resilient wall.

5. The two-component container as defined in claim 1, further comprising a releasable locking ring (17) for temporarily preventing said one (3) of said individual containers from being screwed into said another (2) of said individual containers.

* * * * *